US009599942B2

(12) United States Patent
Tsunoda

(10) Patent No.: US 9,599,942 B2
(45) Date of Patent: Mar. 21, 2017

(54) IMAGE FORMING APPARATUS AND FIXING DEVICE

(71) Applicant: Oki Data Corporation, Tokyo (JP)

(72) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/001,616

(22) Filed: Jan. 20, 2016

(65) Prior Publication Data

US 2016/0252859 A1 Sep. 1, 2016

(30) Foreign Application Priority Data

Feb. 27, 2015 (JP) ..... 2015-038664

(51) Int. Cl.
*G03G 15/20* (2006.01)

(52) U.S. Cl.
CPC ..... *G03G 15/2089* (2013.01)

(58) Field of Classification Search
CPC ..... G03G 15/2032; G03G 15/2017
See application file for complete search history.

(56) References Cited

U.S. PATENT DOCUMENTS 5,351,114 A * 9/1994 Matsuno ..... G03G 15/2064 399/307
2013/0084088 A1* 4/2013 Sakai ..... G03G 15/2064 399/45

FOREIGN PATENT DOCUMENTS

JP 2007121329 A * 5/2007
JP 2013073121 A 4/2013

OTHER PUBLICATIONS

JP_2007121329_A_T Machine Translation, Japan, May 2007, Miyata et al.*

* cited by examiner

*Primary Examiner* — Clayton E Laballe
*Assistant Examiner* — Victor Verbitsky
(74) *Attorney, Agent, or Firm* — Panitch Schwarze Belisario & Nadel LLP

(57) ABSTRACT

An invented image forming apparatus has a fixing device for stably fixing developer on a medium. The fixing device includes a heating member, an endless belt member subject to heating provided from the heating member, a tension member tensioning the belt member, a pressure member forming a pressurized contact nipping portion via the belt member, a supporting member supporting the pressure member, a pushing member pushing the pressure member and the belt member, a fixing member pushing the pressure member and the belt member, a medium guide guiding move of the medium in a direction toward the pressurized contact nipping portion, and a pressure member moving mechanism for moving a position of the pressure member in the supporting member. The image forming apparatus further includes a controller controlling the position of the pressure member via the pressure member moving mechanism.

17 Claims, 8 Drawing Sheets

IMAGE FORMING APPARATUS AND FIXING DEVICE

CROSS REFERENCE TO RELATED APPLICATION

This application claims priority benefits under 35 U.S.C., section 119 on the basis of Japanese Patent Application No. 2015-038664, the disclosure of which is incorporated herein by reference.

BACKGROUND OF THE INVENTION

1. Field of the Invention

This invention relates to an image forming apparatus and a fixing device, and more particularly to an image forming apparatus utilizing an electrophotographic method, such as, e.g., printer, photocopier, facsimile machine, and MFP (Multifunction Peripheral).

2. Description of Related Art

In conventional image forming apparatuses using an electrophotographic method, electrostatic latent images are formed according to image information upon exposing a photosensitive drum surface with an exposure means such as an LED (Light Emitting Diode) head after charging the photosensitive drum surface uniformly with a charge roller, and toner images are formed onto the electrostatic latent images by attaching toner made as a thin layer on a developing roller. Subsequently, the toner images are transferred, with e.g., a transfer roller onto a paper fed from a paper feeding device. The toner images on the paper are then fixed to the paper by a fixing device.

As a conventional image forming apparatus using an electrophotographic method having a fixing device, an apparatus set forth in, e.g., Japanese Patent Application Publication No. 2013-073121(A1) has been known. With the image forming apparatus disclosed in the above publication, the heater applies heat to an endless fixing belt; a nipping portion is formed by pushing a pressure roller placed in opposition to a fixing roller via the fixing belt to sandwich the paper conveyed through the nipping portion, and the toner images are fixed onto the paper by application of heat and pressure.

With such a conventional image forming apparatus having a fixing device using a belt heating method, however, a pad is generally formed for pushing the belt outwardly from the interior at an entrance of the nipping portion. With such a conventional image forming apparatus, when fixing a highly rigid paper such as cardboard, coated paper, label paper, plastic film, the paper may come close on a side of the fixing belt pushed by the pad when the paper is subject to nipping. The toner on the paper in this situation may be melted excessively, thereby possibly causing disadvantages such as gloss blur. In other words, with such a conventional fixing device of the image forming apparatus, good printing quality may not be obtained, depending on the kind of paper, when the paper enters the nipping portion.

SUMMARY OF THE INVENTION

It is therefore an object of the invention to provide an image forming apparatus capable of stably fixing developer images formed on a medium regardless of the kind of the medium.

An image forming apparatus according to one aspect of the invention, includes a fixing device for fixing developer on a medium, the fixing device including: a heating member; an endless belt member subject to heating provided from the heating member; a tension member tensioning the belt member; a pressure member forming a pressurized contact nipping portion together with the belt member; a supporting member supporting the pressure member; a pushing member pushing the pressure member and the belt member; a fixing member pushing the pressure member and the belt member; a medium guide guiding movement of the medium in a direction toward the pressurized contact nipping portion; and a pressure member moving mechanism for moving a position of the pressure member on the supporting member; and further includes a controller controlling the position of the pressure member via the pressure member moving mechanism.

These and other objects, features, aspects and advantages of the disclosed image forming apparatus will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

Figure 1:
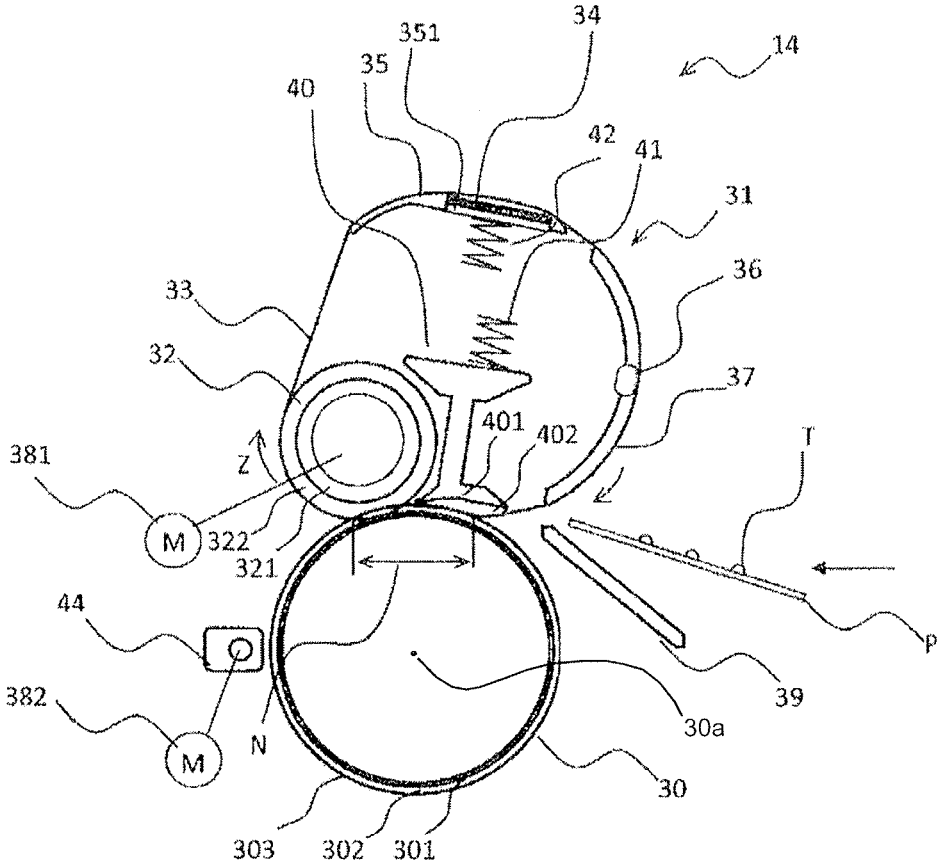
FIG. 1 is a schematic side view showing a fixing device according to an embodiment of the invention.

Hereinafter, referring to the drawings, an image forming apparatus and a fixing device according to an embodiment of the invention are described in detail. In this description, a printer is exemplified as the image forming apparatus of the invention, and the printer has a fixing device.

Figure 2:
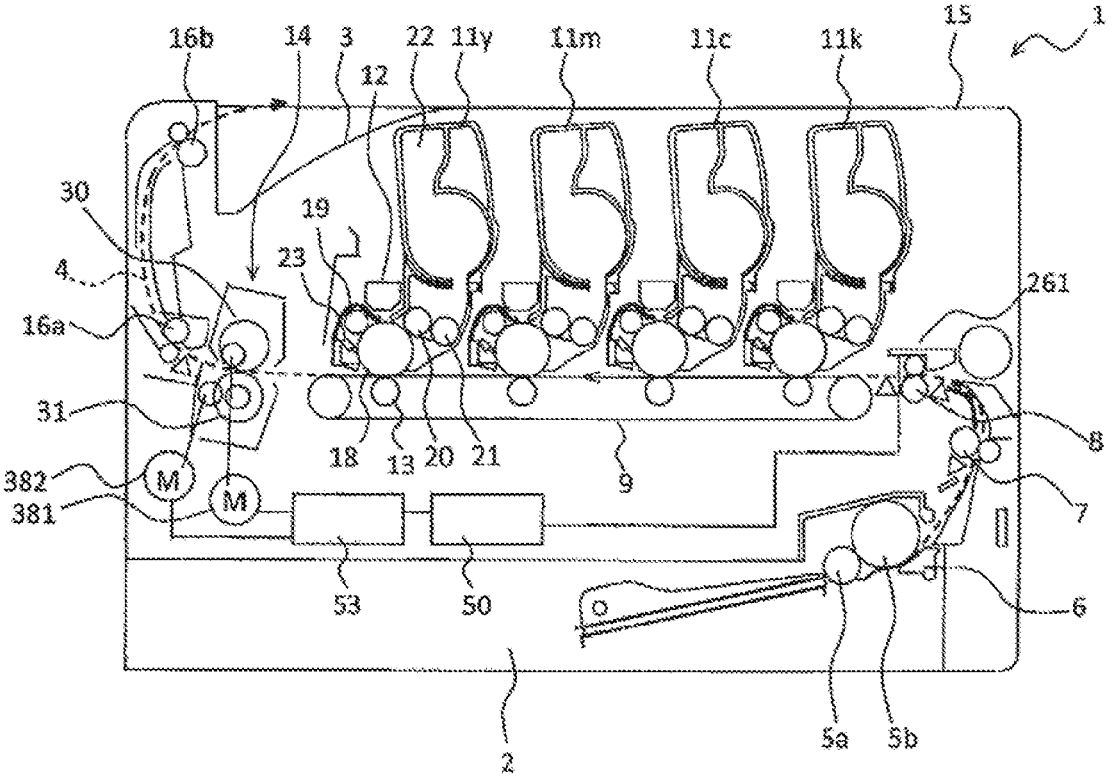
FIG. 2 is a schematic cross section showing a printer according to the embodiment of FIG. 1.

FIG. 2 shows a schematic diagram showing a printer 1 according to this embodiment. The printer 1 is a multicolor printer using an electrophotographic method for printing multicolor images.

As shown in FIG. 2, a paper cassette 2 is detachably attached to the printer 1 at a lower part of an apparatus housing for containing paper P as a printing medium such as, e.g., plain paper. A stacker 3 is disposed on a top surface of the apparatus housing for accumulating image-printed paper P. The paper cassette 2 and the stacker 3 are connected with a paper conveyance route 4 formed approximately in a letter-S shape shown with a broken line in FIG. 2, which forms a conveyance route including an upper surface of the parallel portion of a conveyance belt 9.

A pair of feeding rollers 5*a*, 5*b* and a separation piece 6 are provided at a connection point between the paper conveyance route 4 and the paper cassette 2, as a paper feeding mechanism for feeding paper P sheet by sheet out of the paper cassette 2 in a separating manner to the paper conveyance route 4.

Conveyance rollers 7 for sandwiching and conveying the paper P fed out of the paper feeding mechanism described above, and register rollers 8 for correcting skews of the conveyed paper P and further conveying the paper P are disposed on a downstream side of the conveyance direction of the paper P (hereinafter, referred to as "paper conveyance direction," when seen from the feeding roller 5*b*.

The conveyance belt 9 is disposed on a downstream side of the register roller 8 for conveying the paper P. Plural image forming sections 11 are disposed along the track of the conveyance belt 9 on an upper side of the parallel portion of the conveyance belt 9.

An exposure head 12 is disposed at an upper side of each image forming section 11 for forming electrostatic latent images. A transfer roller 13 is disposed on the opposite side to each image forming section 11 astride the upper surface of the conveyance belt 9 for transferring toner images formed at the image forming section 11 onto the paper P. A fixing device 14 is disposed on a downstream side in the paper conveyance direction of the conveyance belt 9 for fixing the transferred toner images onto the paper P. Plural delivery rollers 16*a*, 16*b* are disposed on a downstream side of the fixing device 14 in the paper conveyance direction for sandwiching and conveying the paper P delivered out of the fixing device 14 to the stacker 3 on an upper cover 15.

Four independent image forming sections 11*k*, 11*c*, 11*m*, 11*y* containing toners T as developers in prescribed colors, or namely, black (k), cyan (c), magenta (m), and yellow (y) are disposed in the printer 1. The image forming sections 11*k*, 11*c*, 11*m*, 11*y* are disposed along the paper conveyance direction in the sequence of forming the toner images. Since all of the four image forming sections 11 have the same structure, one image forming section 11 is described hereinafter.

The image forming section 11 includes, e.g., a photosensitive drum 18 forming electrostatic latent images with the exposure head 12, a charge roller 19 charging uniformly the photosensitive drum 18, a developing roller 20 developing the electrostatic latent images on the photosensitive drum 18 upon attaching the toner T, a feeding roller 21 feeding the toner T onto the developing roller 20, a toner cartridge 22 containing the prescribed color toner T, and a cleaning blade 23 scraping and removing remaining toner T on the photosensitive drum 18 after the transfer. Each of the image forming sections 11 is structured as a united body, respectively and is detachably attached to the printer 1. The upper cover 15 of the printer 1 is therefore structured to be open and closed.

The upper cover 15 supports the exposure head 12 serving as an exposing means, which is disposed above the photosensitive drum 18 as to face the photosensitive drum 18. The exposure head 12 has a light emitting body such as LED light or laser beam, and forms electrostatic latent images on a surface of the photosensitive drum 18 based on the image information. The transfer roller 13, as a transfer means, transfers the toner images formed on the photosensitive drum 18 on the paper P conveyed by the conveyance belt 9 according to a transfer voltage applied.

The fixing device 14 according to this embodiment is a device using a belt heating method, and includes a pressure roller 30 serving as a pressure member and a fixing belt unit 31. The fixing device 14 can be attached to the printer 1 in a united body or can be detachably attached to the printer 1.

A paper thickness sensor 261 is arranged at a position facing the pair of register rollers 8, of the body of the printer 1 in this embodiment. The paper thickness sensor 261 can measure the thickness of the paper P loaded in the printer 1. The output of the paper thickness sensor 261 enters the printer controller 50 of the printer 1 as input.

Figure 3:
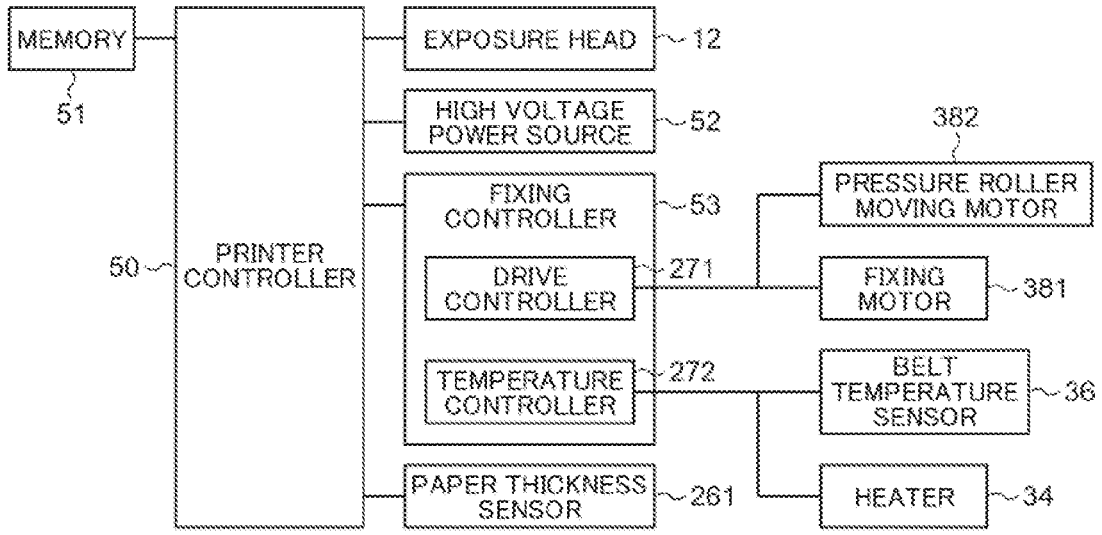
FIG. 3 is a block diagram showing a control system structure in association with the fixing device in the printer according to the embodiment of FIG. 1.
Figure 4:
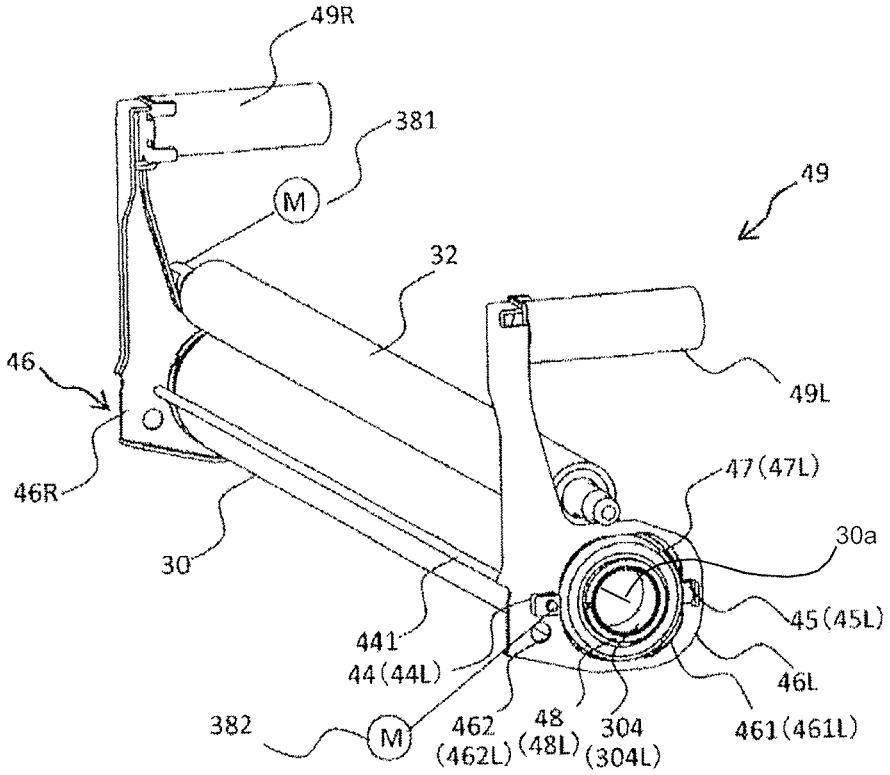
FIG. 4 is a perspective view showing the fixing device according to the embodiment of FIG. 1.

The fixing device 14 is described in detail. FIG. 1 is a schematic side view showing the fixing device 14 according to this embodiment; FIG. 4 is a perspective view showing the fixing device 14 according to the embodiment; and FIG. 3 is a block diagram showing a control system structure in association with the fixing device 14 in the printer 1 according to the embodiment.

Hereinafter, a front side when the fixing device 14 is viewed from the perspective of FIG. 4 is referred to as an L-side (left side), and a rear side when viewed from the perspective of FIG. 4 is referred to as a R-side (right side).

As shown in FIG. 1, the fixing device 14 is formed with a nipping portion N as a pressurized contact nipping portion from the pressurized contact between the fixing belt unit 31 and the pressure roller 30.

In the fixing belt unit 31, disposed on an inner side of a fixing belt 33 are a fixing roller 32 serving as a fixing member, a heater 34 as a heating member, a heater holder 35 and a belt guide 37 serving as a guide for the fixing belt 33. A pad 40 serving as a pushing member and an annular flange member (not shown) as a limiting means against irregular feeding of the fixing belt 33 are disposed in the fixing belt unit 31 adjacently on an upstream side of the fixing roller 32 in the rotation direction or namely the paper conveyance direction. The fixing belt 33 is tensioned by means of the fixing roller 32, the pad 40, and the belt guide 37 and is supported in a rotatable manner. The fixing belt 33 is rotatable in a sliding manner along the heater holder 35 and the belt guide 37. It is to be noted that each of the fixing roller 32 and the pad 40 in the fixing belt unit 31 is disposed extending parallel to and facing the pressure roller 30.

In this embodiment, a tension member for tensioning the fixing belt 33 is formed from, e.g., the heater holder 35 and the belt guide 37.

The pressure roller 30 pushes the fixing roller 32 with a prescribed pushing force of pressure roller springs 49, namely a pair of the pressure roller springs 49L,49R, by a pushing mechanism using pressure roller levers 46, namely a pair of pressure roller levers 46L, 46R, shown in FIG. 4. The pressure roller lever 46 is connected rotatably via a rotary center, or namely a pressure roller lever pivot center hole 462, to a side frame not shown. The pressure roller 30 pushes itself by the opposing force of the pressure roller spring 49 to a center direction (rotary shaft direction) of the fixing roller 32. Rotation of the pressure roller 30 as a pressure member is not necessary, and a stable guide may be used whose surface is covered with a low friction coefficient material, but in this embodiment, the pressure roller 30 is a rotary body driven to rotate about an axis of rotation 30*a* by the fixing belt 33. The pad 40 is urged in a direction pushing the pressure roller 30 against the fixing belt 33 by a pad spring 41 as a pushing member. As the pad spring 41, for example, a compression coil spring may be used.

According to the above structure, a nipping portion N having a prescribed width in the paper conveyance direction is formed between the fixing belt unit 31 and the pressure roller 30.

Figure 6:
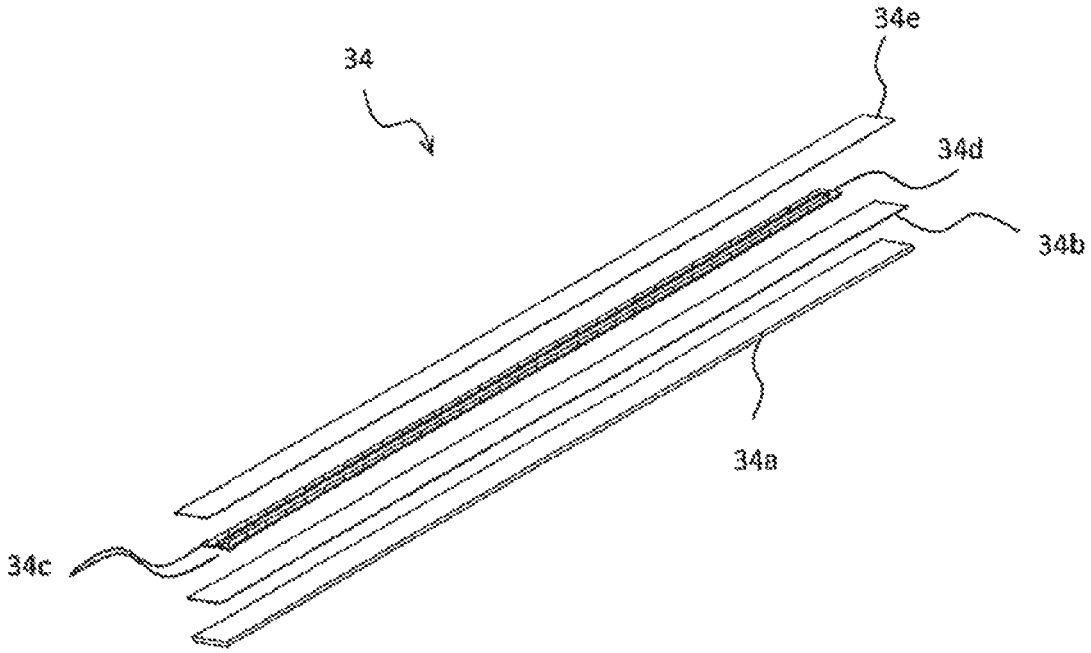
FIG. 6 is an exploded perspective view showing an area heater according to the embodiment of FIG. 1.

Next, a structural example of the heater 34 is described in reference to FIG. 1 and FIG. 6. FIG. 6 is an exploded perspective view showing the heater 34.

The heater 34 as a heating member can be formed of an area heater, as shown in FIG. 6, structured by forming an electric isolation layer 34*b* made of, e.g., glass on a substrate 34*a* made of, e.g., stainless steel or ceramic, by forming a resistor heater 34*d* having an electrode 34*c* on the layer 34*b*, and by protecting the resistor heater 34 with a protection layer 34*e*. As the resistor heater 34*d*, materials such as, e.g., nickel-chrome alloy, silver-palladium alloy are usable. A glass coating may be provided on the protection layer 34*e* with a glass capable of withstanding pressure.

The heater holder 35 is arranged away from the fixing roller 32 on a side opposite to the pressure roller 30 and is arranged facing the fixing roller 32. The heater holder 35 can be made of a high heat-resistant resin such as, e. g, polyether ether ketone (PEEK), liquid crystal polymer (LCP) or a metal such as, e.g., copper, aluminum alloy having a good heat conductivity.

The heater holder 35 has a groove having substantially the same width as the heater 34 on a surface facing an inner peripheral surface of the fixing belt 33, and the heater 34 is disposed in the groove. The heater 34 is secured in the groove of the heater holder 35 in a state such that heat resistant grease is filled in a gap along the longitudinal direction of the groove. The heater holder 35 is urged with a prescribed pushing force of the heater spring 42 in a direction tensioning the fixing belt 33 by means of a pushing mechanism not shown. A pressure plate 351 is provided on a surface facing the heat generating surface of the heater 34 and sandwiched between the heater 34 and the heater spring 42.

As shown in FIG. 1, the belt guide 37 is molded in a partial cylinder shape. The belt guide 37 is made of a material such as, e.g., LCP, and poly phenylene sulfide (PPS). A surface of the belt guide 37 subjected to friction from the fixing belt 33 is desirably formed with, e.g., ribs for reducing the contact area to reduce the heat taken from the fixing belt 33.

The pad 40 has a support base 401, and a heat resistant elastic material 402 secured to the support base 401 with an adhesive. It is desirable to form a sliding layer having a small friction resistance on the surface of the elastic material 402. The support base 401 can be formed of, e.g., a metal such as steel, and aluminum alloy. The elastic material 402 is formed with an arc-shaped surface to have the same radius of curvature as the pressure roller 30. The sliding layer of the elastic material 402 is used for reducing the friction resistance against the inner peripheral surface of the fixing belt 33.

The pad spring 41 is disposed in a plural number in the longitudinal direction of the pad 40, and is designed to be so positioned as to make equal the pressure in the longitudinal direction. The width of the nipping portion N is changeable according to changes of the length of the arc face of the pad 40.

As the fixing belt 33, a flexible member can be employed in forming a heat-resistant elastic layer such as, e.g., silicone rubber, and fluoric resin on an outer periphery of a cylinder-shaped belt material made of, e.g., heat resistant nickel electrocasting, polyimide, and stainless steel (e.g., SUS304), and forming a mold releasing layer made of such as, e.g., fluoric resin on an outer periphery of the elastic layer. The fixing belt 33 is driven to rotate with the fixing roller 32 according to friction force occurring at the nipping portion N in association with the rotation of the fixing roller 32, and is heated with the heater 34.

The fixing roller 32 can be structured of, e.g., a metal core 321 (for example, metal pipe or shaft made of steel or aluminum alloy) and an elastic layer (for example, heat resistant layer such as silicone rubber and fluoric resin). The fixing roller 32 is supported in a rotatable manner with bearings (not shown), and is driven to rotate in a direction conveying the paper P in the paper conveyance direction (shown in FIG. 1 with arrow Z) by drive force transmitted from a fixing motor 381, shown in FIG. 2, to a fixing roller gear or gears (not shown) but formed at the metal core 321.

The pressure roller 30 can be structured of, e.g., a metal core 321 (for example, metal pipe or shall made of steel or aluminum alloy), an elastic layer (for example, heat resistant layer such as silicone rubber and fluoric resin), and a mold releasing layer (for example, a layer made of, for example, fluoric resin). As shown in FIG. 4, the pressure roller 30 is rotatably supported with the ball bearings 47 to the pressure roller levers 46 via sleeves 48 at pressure roller ends 304. In other words, the pressure roller 30 is supported by the supporting member including the ball bearings 47.

The pressure roller 30 is driven to rotate about the axis of rotation 30*a* according to rotation of the fixing belt 33, which is driven to rotate according to friction force occurring at the nipping portion N in accompany with the rotation of the fixing roller 32.

The paper P to which the toner is transferred is conveyed along the paper guide 39, and enters in the nipping portion N in passing over the tip of the paper guide 39. The paper guide 39 is made as a medium guide for guiding the transfer of the paper P to the nipping portion N.

The a belt temperature sensor 36 is disposed on the belt guide 37, or namely at an area in sliding contact with an inner peripheral surface of the fixing belt 33, as a temperature detecting means for detecting the temperature of the inner peripheral surface upon contacting in a sliding manner the inner peripheral surface of the fixing belt 33. In other words, the belt temperature sensor 36 is disposed at a point on an upstream side in the rotation direction of the fixing belt 33 between the heater 34 of the fixing device 14 and the nipping portion N. The belt temperature sensor 36 is disposed as to contact the inner peripheral surface of the fixing belt 33, and detects the temperature of the inner surface of the fixing belt 33. As the belt temperature sensor 36, a device such as a thermistor may be used.

In this embodiment, the heater holder 35 is a united body holder molded from extrusion of aluminum A6063, whereas the pressure plate 351 is structured from aluminum A5052 with a thickness 1 mm.

In this embodiment, the pressure roller 30 is formed from a steel pipe having a diameter of 33.6 mm, a thickness of 0.7 mm, and a length of 330 mm (e.g., carbon steel pipe for mechanical structure (STKM)) as the metal core 301, and a foamed silicone rubber (sponge) layer having a thickness of 1 mm on the outer peripheral surface of the pipe as an elastic layer 302. A perfluoro vinyl ether copolymer (PFA) resin tube having a thickness 30 micro meters as the mold releasing layer 303 covers the surface of the elastic layer 302. That is, in this embodiment, the pressure roller 30 is a roller having an outer diameter of 45 mm. In this embodiment, also, the pressure roller 30 has a roller product hardness of ASKER-C75.

In this embodiment, the fixing roller 32 is formed from a steel pipe having a diameter of 21 mm, a thickness of 1.5 mm, and a length of 330 mm (e.g., carbon steel pipe for mechanical structure (STKM)) as the core metal 321. A foamed silicone rubber (sponge) layer having a thickness of 2 mm is formed on the outer peripheral surface of the core metal 321 as an elastic layer 322. Accordingly, in this embodiment, the fixing roller 32 is a roller having an outer diameter of 22 mm. In this embodiment, also, the fixing roller 32 has a roller product hardness of ASKER-C70.

In this embodiment, the fixing roller 32 is made in a crown shape having a center outer diameter 0.3 mm larger than the outer diameter at each end so that the pressure profile on the pressure roller 30 in the length direction becomes uniform.

In this embodiment, the pad 40 is formed from a support substrate 401 made of aluminum alloy (A6063), an elastic layer 402 made of silicone rubber, and a surface of the pad 40, or namely, a sliding layer, coated with a silicone based resin containing graphite having a thickness of 30 micro meters, and is designed to have a an arc length of 6 mm of the arc surface. In this embodiment, the silicone rubber hardness used for the elastic layer 402 is set to JISA40. In this embodiment, further, the pad 40 is made in a crown shape having a center portion with a projection of 0.2 mm greater than each end so that the pressure profile on the pressure roller 30 in the length direction becomes uniform. In this embodiment, although the surface of the pad 40 (sliding layer) is structured as a coating layer, a sheet shaped fluoric resin may constitute to cover the elastic layer 402.

In this embodiment, an interval between the pad 40 of the nipping portion N and the fixing roller 32 is set to about 1 mm. Although the nipping portion N of the pad 40 is formed in the arc shape in this embodiment, a flat shape may be formed for the nipping portion N.

In this embodiment, the fixing belt 33 is formed of an endless belt using a polyimide (PI) resin made cylindrical member having a thickness of 80 micron meters as a belt base, forming a silicone rubber layer having a thickness of 200 micron meters as an elastic layer, and forming a PFA resin layer having a thickness of 20 micron meters as a mold releasing layer. If a belt peripheral length becomes longer, a temperature increasing time becomes longer, and if the length becomes shorter, space becomes less so as to make not available the outer diameter of the fixing roller and the layout of the pad base size, which are required for ensuring the nipping width. Accordingly, in this embodiment, the inner diameter of the fixing belt 33 is set to 45 mm, and the length is set to 330 mm, with respect to the structures of the fixing roller 32 and the pad 40.

In this embodiment, the pressure roller 30 is designed as to push the fixing roller 32 on one end with 15 kgf and on both ends with 30 kgf according to prescribed pushing force of the pressure roller springs 49 by means of a pushing mechanism using the pressure roller lever 46 shown in FIG. 4. Furthermore, in this embodiment, the pad 40 is set to push the pressure roller 30, respectively, with a total gross load 10 kgf.

In this embodiment, with the structure describe above, the nipping width made between the pressure roller 30 and the fixing roller 32 is set to 6 mm, whereas the nipping width made between the pressure roller 30 and the pad 401 is set to 5 mm, during a normal period, or namely, during a normal position as described below. In this embodiment, therefore, the width of the nipping portion N becomes approximately 11 to 12 mm.

Referring to FIGS. 4, 5, the structure changing the position of the pressure roller 30 is described next.

Figure 5A:
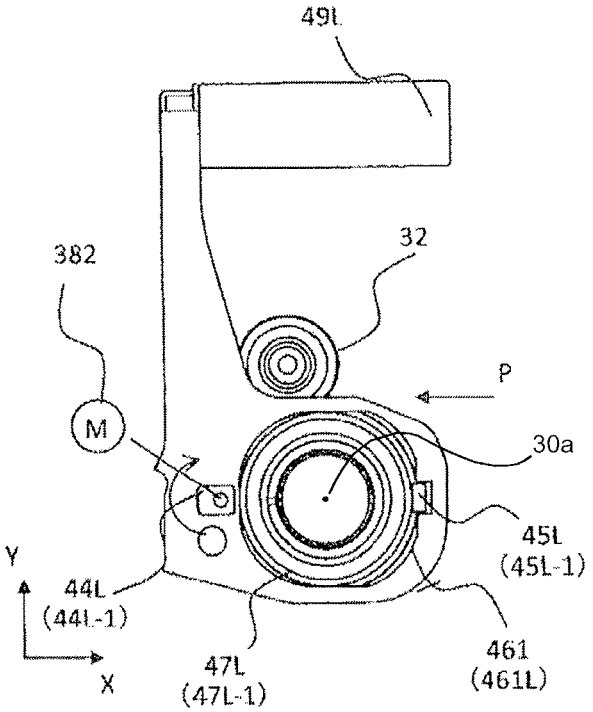
FIGS. 5A, 5B are illustrations showing move of a pressure roller in the fixing device according to the embodiment.
Figure 5B:
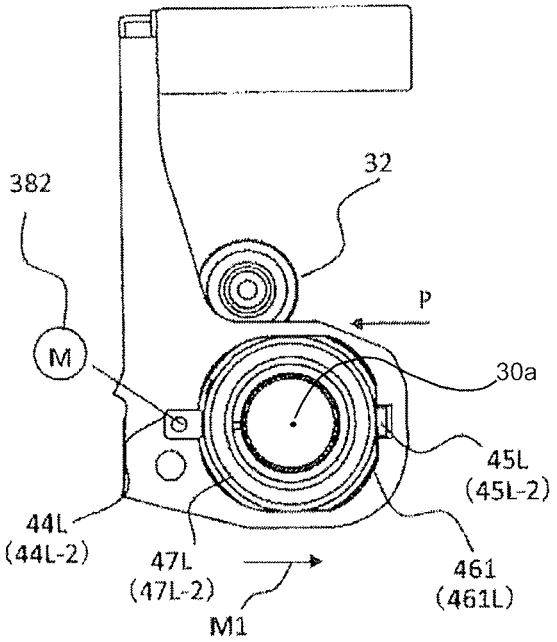

FIG. 5A, 5B are illustrations showing a structure changing the position of the pressure roller 30 in the fixing device 14, or namely a structure of a pressure member moving mechanism; FIG. 5A and FIG. 5B are schematic side views showing the fixing device 14 in the respective states.

It is to be noted that although an L (left) side structure, or a front side when viewed from FIG. 4 and FIGS. 5A, 5B is illustrated as essential for the interior of the fixing device 14, a part of an R(right) side structure is omitted from the illustrations, because the R side structure, or a rear side when viewed from FIG. 4 and FIG. 5 is substantially the same as an L side as a symmetric structure. More specifically, in FIG. 4, 5A, 5B, the L side portions (at the end) of the pressure roller end 304, a pressure roller moving cam 44, a pressure roller tension spring 45, a pressure roller lever pivot center hole 462, the sleeve 48, a ball bearing receiving hole 461, and the ball bearing 47 are assigned with reference numbers 304L, 44L, 45L, 48L, 461L, and 47L, but the R side portions are substantially the same (symmetric), so that illustrations are omitted.

In FIG. 5A, the positions of the pressure roller move cam 44L, the pressure roller tension spring 45L, and the ball bearing 47L, where the pressure roller 30 is in a first position, or namely "normal position" as described below, are illustrated as 44L-1, 45L-1, 47L-1. In FIG. 5B, the positions of the pressure roller move cam 44L, the pressure roller tension spring 45L, and the ball bearing 47L, where the pressure roller 30 is in a second position, or namely "cardboard position" as described below, are illustrated as 44L-2, 45L-2, 47L-2.

As shown in FIG. 5A, the pressure roller lever 46 has the ball bearing receiving hole 461 supporting the ball bearing 47 holding rotationally the pressure roller end 304.

The ball bearing receiving hole 461 of the pressure roller lever 46 is formed in having the same width as the outer diameter of the ball bearing 47 in Y-direction in FIG. 5A, and is formed in approximately an oval shape having a width of the outer diameter of the ball bearing 47 plus 1 mm in X-direction (lateral direction), or on an upstream side of the paper conveyance direction, or a direction toward the paper guide 39. The pressure roller move cam 44 and the pressure roller tension spring 45 are disposed on a line extending X-direction passing through the center of the ball bearing 47 fitted into the ball bearing receiving hole 461, as the same center of the pressure roller 30.

The pressure roller move cam 44 is jointed with each end of a pressure roller move cam shaft 441 penetrating the pressure roller levers 46L, 46R shown in FIG. 4, and is arranged on an outer side face of the pressure roller levers 46L, 46R. In FIG. 4, and FIGS. 5A, 5B, only the pressure roller move cam 44L on the L-side is shown, but substantially the same pressure roller move cam 44R is disposed at an end on the R-side of the pressure roller move cam shaft 441.

The pressure roller move cam shaft 441 and the pressure roller move cams 44L. 44R are supported to the pressure roller levers 46L, 46R in a unitedly rotatable manner upon driven by a pressure roller move motor 382.

As shown in FIG. 5A, the pressure roller tension spring 45L operates to push the ball bearing 47L as to contact the pressure roller lever 46L on a downstream side in the conveyance direction of the paper P by applying tension in −X-direction at a position that the pressure roller move cam 44L does not contact the outer periphery surface of the ball bearing 47L, or the position 47L-1. Hereinafter, the state that the pressure roller 30 is located as shown in FIG. 5A is referred to as "normal position" or "first position."

If the pressure roller move cam 44L moves or rotates 180 degrees from the position 44L-1 to the position 44L-2 by the action of the pressure roller move motor 382, the ball bearing 47L as shown in FIG. 5B moves in M1 direction by the amount by which the ball bearing 44L is pushed by the cam 44L from the position 47L-1 to the position 47L-2.

In this embodiment, the pressure roller 30 moves from the state contacting the side face of the cam 44L of the ball bearing 461 to the state contacting the side face of the pressure roller tension spring 45, or namely moves 1 mm. Because the cams 44L. 44R operate to move in the same phase with the shaft 441, the pressure roller 30 can move parallel to the position above in the pressure roller levers 46L, 46R. Hereinafter, the state that the pressure roller 30 is located as shown in FIG. 5B is referred to as "cardboard position" or "second position."

When the pressure roller move cam 44 returns from the position 44L-2 to the position 44L-1, the ball bearing 47L moves from the position 47L-2 to the position 47L-1 or move in −M1 direction upon shifting of the pressure roller tension spring 45 from the position 45L-2 to the position 45L-1, so that the pressure roller can return to the normal position.

Referring to FIG. 3, a structure of the control system relating to the fixing device 14 is described below.

In FIG. 3, as a structure of the control system relating to the fixing device 14, shown are a printer controller 50, a memory 51, a high voltage power source 52, a fixing controller 53, a paper thickness sensor 261, the fixing motor 381, the pressure roller move motor 382, the belt temperature sensor 36, and the heater 34. As shown in FIG. 3, the fixing controller 53 includes a drive controller 271 and a temperature controller 272. In the printer 1, the controller is structured of the printer controller 50 and the fixing controller 53 for control relating to the fixing device 14.

The printer controller 50 is a control means for the printer 1, and is connected to a host apparatus such as, e.g., a personal computer via, for example, communication lines (not shown). The printer controller 50 functions for executing printing processing and controlling respective portions in the printer 1 and for controlling data communications with the host apparatus.

The memory 51 is a memory unit for the printer 1 and stores various programs executed at the printer controller 50 and various data used for the controller 50, as well as processing results from the printer controller 50.

The high voltage power source 52 functions as a power source generating high voltages, and applies voltages to, e.g., the charge roller 19, the developing roller 20, the supply roller 21, and the transfer roller 13, based on instructions of the printer controller 50. E.g., the charge roller 19, the developing roller 20, and the supply roller 21 are electrically connected to the high voltage power source 52 when the image forming section 11 is attached to the printer 1.

The fixing controller 53 is a controller for the fixing device 14, and based on the instructions from the printer controller 50, power for heating the heater 34 of the fixing device 14 is supplied from a power supply circuit. The fixing controller 53 rotates the fixing roller 32 in the paper conveyance direction upon supplying electric power to the fixing motor 38. The fixing controller 53 receives, for example, the temperature of the fixing belt 33 detected by the belt temperature sensor 36, and the surface temperature of the pressure roller 30 detected by the pressure roller temperature sensor 37. The printer controller 50 controls turning on and off the electric power supplied to the heater 34 with the fixing controller 53 or the temperature controller 272 based on the temperature of the fixing belt 33 received at the fixing controller 53, thereby maintaining the surface temperature of the fixing belt 33 at a prescribed fixing temperature.

Next, a control structure for the fixing device 14 is described. The fixing belt 33 is heated by the heater 34. The surface temperature of the fixing belt 33 at that time is detected with the belt temperature sensor 36, and is controlled to maintain the prescribed setting temperature by the temperature controller 272 as shown in FIG. 3. The fixing roller 32 rotates upon reception of drive force from the fixing motor 381 to the gear united to the end of the metal core 321. The fixing motor 381 is controlled by the drive controller 271.

The printer controller 50 instructs the fixing device control based on, e.g., the instruction signal from the host apparatus or the personal computer as well as manipulations or a manipulation signal from a user.

The thickness of the paper P processed in the printer 1 can be measured with the paper thickness sensor 261 located at a position facing the pair of register rollers 8 in the housing of the printer 1 in this embodiment. Although the paper thickness sensor 261 is not limited as having a specific structure, possible structures are, e.g., a structure in which thickness of the paper P is measured mechanically (for example, the thickness is measured upon sandwiching the paper P with levers not shown) or a structure in which the thickness of the paper P is measured optically (for example, the thickness is measured according to a transparency of the paper P to light).

The output of the paper thickness sensor 261 enters the printer controller 50. In this embodiment, the output of the heater 34 is set to 1100 W. In this embodiment, paper of 80 $g/m^2$ is employed as the normal paper P (non-cardboard paper P), and operation in which the paper P is printed in the printer 1 with long edge feeding (in which the paper conveyance direction becomes parallel to the short edge direction of A4 paper) is described. Furthermore, in this embodiment, the printer 1 prints the paper P described above (as not cardboard) with a rate of 50 ppm (Page Per Minute).

In this embodiment, the printer controller 50 is described as recognizing the paper P having thickness corresponding to paper measuring weight 300 $g/m^2$ or more as the cardboard. In this embodiment, the printer controller 50 is designed to control the setting speed during the fixing operation to be 18 ppm and the target temperature of the fixing belt 33 to be 160 degrees Celsius, for the paper P recognized as the cardboard.

In a printing operation of the printer 1, when receiving a printing instruction (for example, a printing instruction from the host apparatus such as, e.g., a computer (not shown)), the printer controller 50 begins printing according to the printing instruction.

The printer controller 50 feeds the paper P contained in the paper cassette 2 into the paper conveyance route 4 upon separating the paper sheet by sheet with the feeding rollers 5*a*, 5*b* and the separation piece 6, and makes the paper P conveyed with the conveyance belt 9 by means of the conveyance roller 7 and the register roller 8.

Concurrently, the printer controller 50 applies preset prescribed voltages to respective rollers and the transfer roller 13 in or around the respective image forming sections 11 from the high voltage power source 52, and charges uniformly the surface of the respective photosensitive drums 18 with the charged voltages applied to the charge roller 19 in the respective image forming sections 11.

The printer controller 50 renders the respective exposure heads 12 emit according to image information based on the printing instruction, and exposes the surfaces of the respective photosensitive drums 18 to form electrostatic latent images on the surfaces, and makes development by attaching to the electrostatic latent images on the photosensitive drums 18 toner T supplied from the feeding roller 21 by the developing roller 20. With this operation, the toner images are formed on the surfaces of the photosensitive drums 18.

Subsequently, as the paper P is conveyed to the image forming sections 11 by the conveyance belt 9, toner images in respective colors of black, cyan, magenta, and yellow are sequentially transferred according to the transfer voltage applied to the transfer rollers 13 when the paper P passes between the photosensitive drums 18 and the transfer rollers 13, thereby forming multicolor toner images.

When the paper P formed with the transferred toner images is conveyed to the fixing device 14, the fixing device 14 fixes the toner images onto the paper P, and the paper P with the fixed toner images is delivered to the stacker 3 on the top cover 15 by the delivery roller 16*b* after being conveyed by the delivery roller 16*a*, and are stacked on the stacker 3.

Next, the fixing operation in the fixing device 14 is described. First, according begin the printing operation in the printer 1, the printer controller 50 rotates the fixing motor 381 with the fixing controller 53, and drives the roller gear of the fixing roller 32 to rotate in the paper conveyance direction via a gear train, not shown, disposed to the body of the printer 1. With this operation, the fixing belt 33 is driven to rotate with friction force at the nipping portion N generated by the rotation of the fixing roller 32.

The printer controller 50, via the fixing controller 53, activates the heater 34 to generate heat upon supplying electric power from the feeding circuit (not shown) to the heater 34, thereby heating the fixing belt 33 from an inner periphery side. The temperature of the fixing belt 33 heated by the heater 34 is detected by the belt temperature sensor 36 and inputted into the fixing controller 53. The fixing controller 53 turns on and off the heater 34 based on the detected temperature of the fixing belt 33, or namely turns on and off the electric power fed to the heater 34 from the feeding circuit (not shown), thereby controlling the surface temperature of the fixing belt 33 to keep a prescribed fixing temperature. While it is in a state that the surface temperature of the fixing belt 33 is kept at the prescribed temperature, if the paper P with transferred toner images is conveyed, the paper P is sandwiched at the nipping portion N formed with the pad 40, the fixing roller 32, and the pressure roller 30 via the fixing belt 33. With this operation, the heat at the prescribed fixing temperature given from the fixing belt 33 and the pressure of the prescribed pushing force is applied to the paper P having the transferred toner images, so that the toner images are fixed to the paper P.

In this embodiment, from a viewpoint to prevent the temperature of the fixing belt 33 from excessively rising, it is desirable for the fixing roller 32 to begin rotating with no delay from the timing of heating start of the fixing roller 32. In this embodiment, therefore, the fixing roller 32 starts rotating at the same time as the heating starts. In this embodiment, the target temperature of the fixing belt 33 is set to 160 degrees Celsius, and the temperature of the fixing belt 33 after turning on of the heater 34 is controlled to be in a prescribed temperature range having the target temperature as a center value thereof when the fixing operation is executed.

Figure 7:
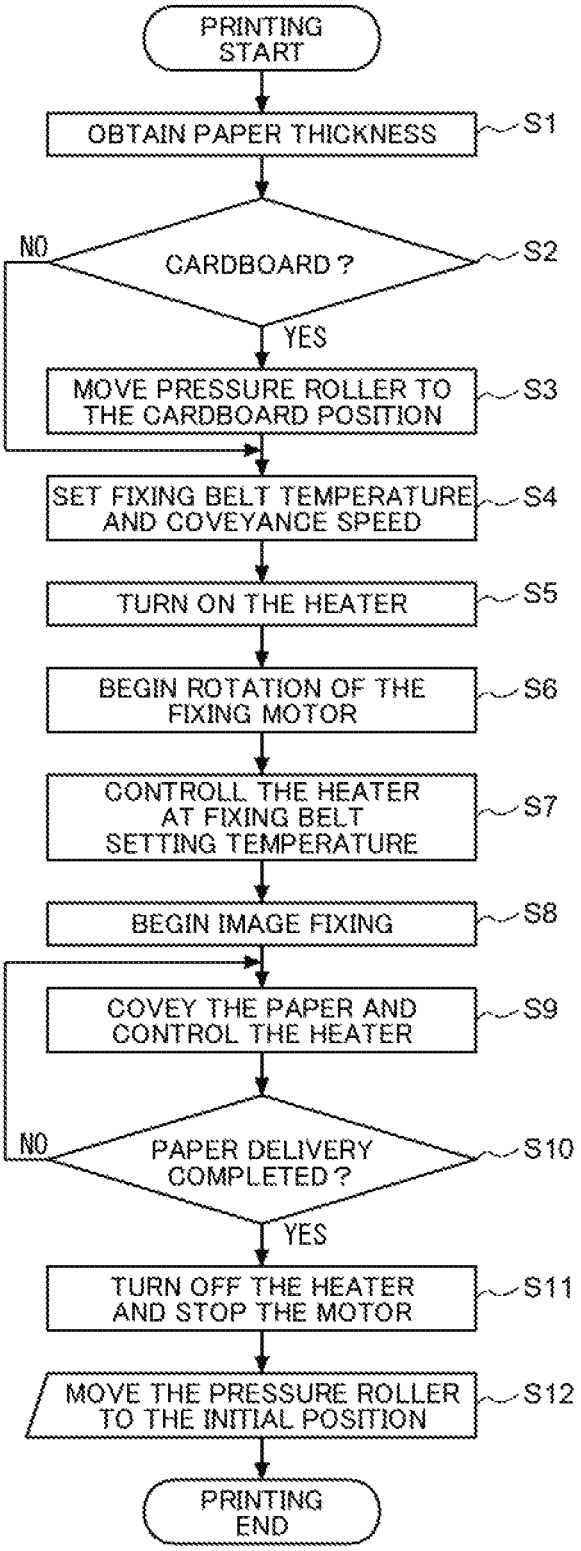
FIG. 7 is a flowchart showing operation of the printer according to the embodiment.

Referring to FIG. 7, a flowchart, the detailed controls of the fixing device 14 by the printer controller 50 and the fixing controller 53 are described. In FIG. 7, the operation for controlling the fixing device 14 by the printer controller 50 and the fixing controller 53 according to the thickness of the paper P is shown essentially. The pressure roller 30, is initially set to the normal position.

As shown in FIG. 7, the printer controller 50 obtains the thickness of the supplied paper P from the paper thickness sensor 261 after beginning the printing operation (Step S1).

The printer controller 50 judges as to whether the paper P is recognized as the cardboard in accordance with the thickness of the obtained paper P (Step S2). If it is judged as the cardboard, the operation goes to Step S3 described below, and if not, the operation goes to Step S4.

For example, if the thickness of the paper P is equal to or greater than a threshold value, the printer controller 50 judges that the paper P is cardboard, and if not, the controller 50 judges that the paper P is not cardboard (but is a normal paper).

If the paper P is judged as cardboard at Step S2, the printer controller 50 instructs the fixing controller 53 to drive the pressure roller move motor 382 to rotate the pressure roller move cam 44 and further to move the pressure roller 30 to the cardboard position (Step S3).

Subsequently, the printer controller 50 sets the fixing temperature and the paper conveyance speed to be suitable for the thickness of the paper P to the fixing controller 53 (Step S4).

After setting various parameters, the fixing controller 53 begins energizing the heater 34 from the temperature controller 272 (Step S5).

At that time, the fixing controller 53 or the drive controller 271 begins the fixing roller 32 driving at a set rotation speed of the fixing motor 381, or namely, a rotation speed based on the setting at Step S4 (Step S6). With the printer controller 50 or the fixing controller 53 in this embodiment, if it is the cardboard position, as described above, the setting speed during the fixing operation is 18 ppm, and the target temperature of the fixing belt 33 is set to 160 degrees Celsius.

Then, the fixing controller 53, or the temperature controller 272 controls the heater 34 so that the detected temperature of the belt temperature sensor 36 is kept at the target temperature of the fixing belt 33, e.g., at 160 degrees Celsius in the case of the cardboard position (Step S7).

According to the control described above, the printer controller 50 and the fixing controller 53 control the fixing device 14 to be in a state capable of beginning image fixing operation (operation for fixing processing on the paper P) (Step S8).

Where the image fixing operation is started, and where the paper P enters in the nipping portion N, the fixing controller 53 controls the heater 34 as to maintain the fixing belt 33 at the target temperature while at least the paper P passes through the nipping portion N or namely until the paper P is delivered out of the fixing device 14, and controls conveyance and delivery of the paper P or the cardboard, or namely controls rotation of the fixing motor 381 (S9, S10).

After the paper P passes through the nipping portion N, or namely after the paper P is delivered from the fixing device 14, the fixing controller 53 turns off the heater 34, and stops the fixing motor 381, thereby stopping the rotation of the fixing roller 32 (Step S11).

Then, the fixing controller 53 drives the pressure roller move motor 382 to move pivotally the pressure roller move cam 44, thereby returning the pressure roller 30 to the normal position (the initial position or default position) (Step S12). If the pressure roller 30 is originally in the state of the normal position, or namely if the pressure roller is not the position of the cardboard, the fixing controller 53 does not make a process changing the position of the pressure roller 30.

Figure 8A:
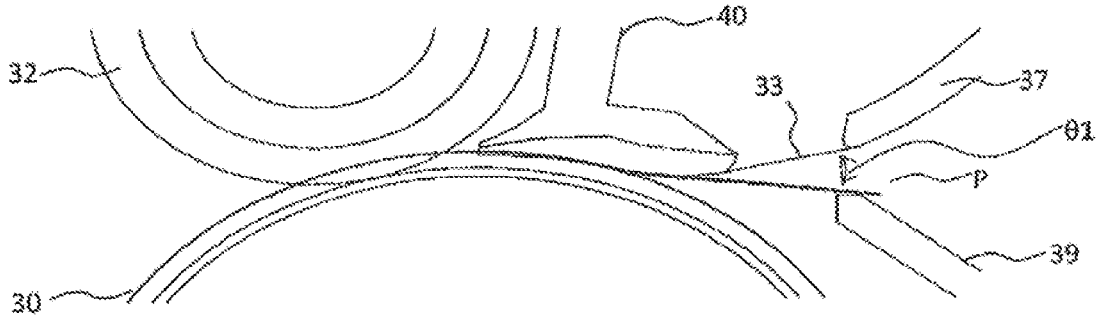
FIGS. 8A to 8C are illustrations showing changes in a nipping portion according to the move of the pressure roller in the fixing device according to the embodiment.
Figure 8B:
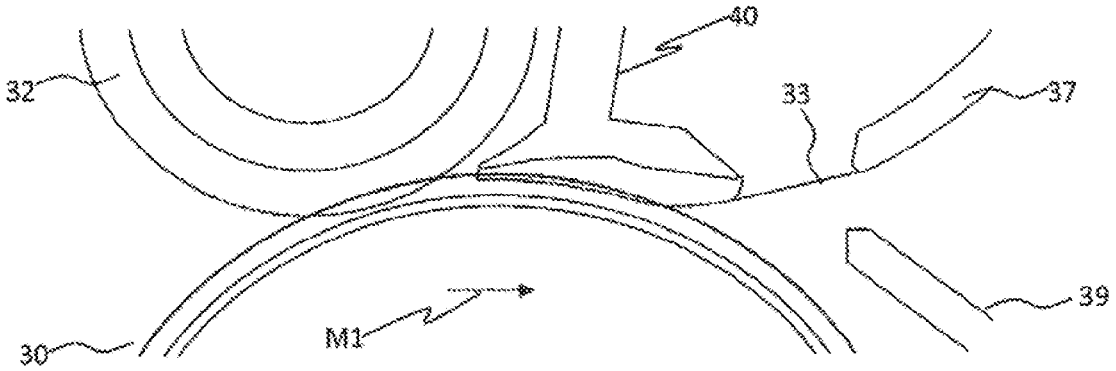
Figure 8C:
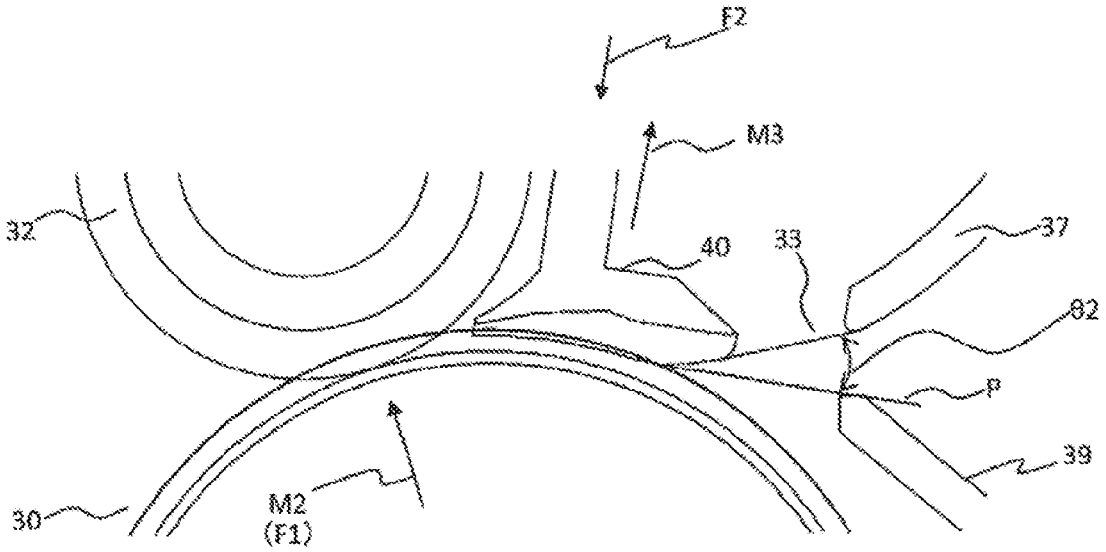

Referring to FIG. 8, changes of the nipping portion N in association with the position changes of the pressure roller 30 are described. FIGS. 8A to 8C show enlarged cross sections showing the nipping portion N where the pressure roller 30 is in the normal position.

FIG. 8A shows the nipping portion N where the pressure roller 30 is in the normal position. In FIG. 8A, the nipping portion N is shown as in the state that the ball bearing 47 is at the position 47L-1 (the normal position) in FIG. 5A at the ball bearing receiving hole 461 of the pressure roller lever 46. At that time, an angle between (a) a surface or plane of the paper P passing through the highest portion of the paper guide 39, or namely through an end of the paper guide 39 on the downstream side in the paper conveyance direction, and entering into the beginning point of the pressurized contact nipping portion (that is, into the contact nipping start position made by the pad 40 and the pressure roller 30), or into an end of the paper guide 39 on the upstream side in the paper conveyance direction, and (b) a surface or plane of the fixing belt 33 entering from the belt guide 37 to the pad 40 is set to "θ1."

The heat of the fixing belt 33 may be conducted to a surface of the paper P to which toner is transferred (hereinafter referred to as "the toner surface") where the toner surface of the paper P comes close enough to the fixing belt 33 before entering into the nipping portion N according to the positional relation between the toner surface and the fixing belt 33 determined from the amount of the angle θ1, so that the toner surface of the paper P may be heated excessively. In this case, the toner of the toner surface of the paper P may be melt excessively when passing through the nipping portion N, thereby causing failures of gloss unevenness.

In FIG. 8B, the nipping portion N is shown as in the state immediately after the ball bearing 47 moves to the position 47L-2, or namely the position moved in the M1 direction from the position 47L-1, at the ball bearing receiving hole 461 of the pressure roller lever 46. At that time, because the shaft position of the fixing roller 32 is not moved, where the pressure roller 30 moves in a direction coming closer to the paper guide 39, the nipping amount between the fixing roller 32 and the pressure roller 30, or namely a nipping overlapping amount, comes into a relation less than the state shown in FIG. 8A or the normal position.

FIG. 8C shows the nipping portion N as in the state that the pressure roller 30 returns to the fixing roller 32 to make the normal nipping amount (nipping overlapping amount) after the ball bearing 47 moves to the position 47L-2 in FIG. 5A at the ball bearing receiving hole 461 of the pressure roller lever 46. The pressure roller 30 is pushed to the fixing roller 32 or pushed in the direction of M2 by the pressure roller lever spring 49 via the pivot center hole 462 of the pressure roller lever 46. A reduced amount of overlapping due to the move to the position 47L-2 is resumed as the positional relation (overlapped position) determined from a hardness relation between the fixing roller 32 and the pressure roller 30, according to the lever load (F1) occurring from the tension of the spring 49.

At that time, where the pressure roller 30 comes closer to the side of the paper guide 39, the pad 40 moves in a direction (direction of M3) pushed by the pressure roller 30. With this operation, the pad load (F2) becomes larger as the pad 40 has a shorter spring exertion length. At that time, an angle between (a) a surface or plane of the paper P passing through the highest portion of the paper guide 39, or namely through an end of the paper guide 39 on the downstream side in the paper conveyance direction, and entering into the beginning point of the pressurized contact nipping portion (that is, into the contact nipping start position made by the pad 40 and the pressure roller 30), and (b) a surface or plane of the fixing belt 33 entering from the belt guide 37 to the pad 40 is set to "θ2." As the positional relation between the paper toner surface of angle θ2 and the fixing belt 33, the relation becomes θ1<θ2, so that the distance to the fixing belt 33 before entry to the nipping portion N can be made better, or namely that the distance can be made longer than in the state shown in FIG. 8A. With this operation, in the state shown in FIG. 8C, the toner on the toner surface on the paper P can be prevented from excessively melting more than the state shown in FIG. 8A, so that failures of gloss unevenness can be suppressed.

Figure 9:
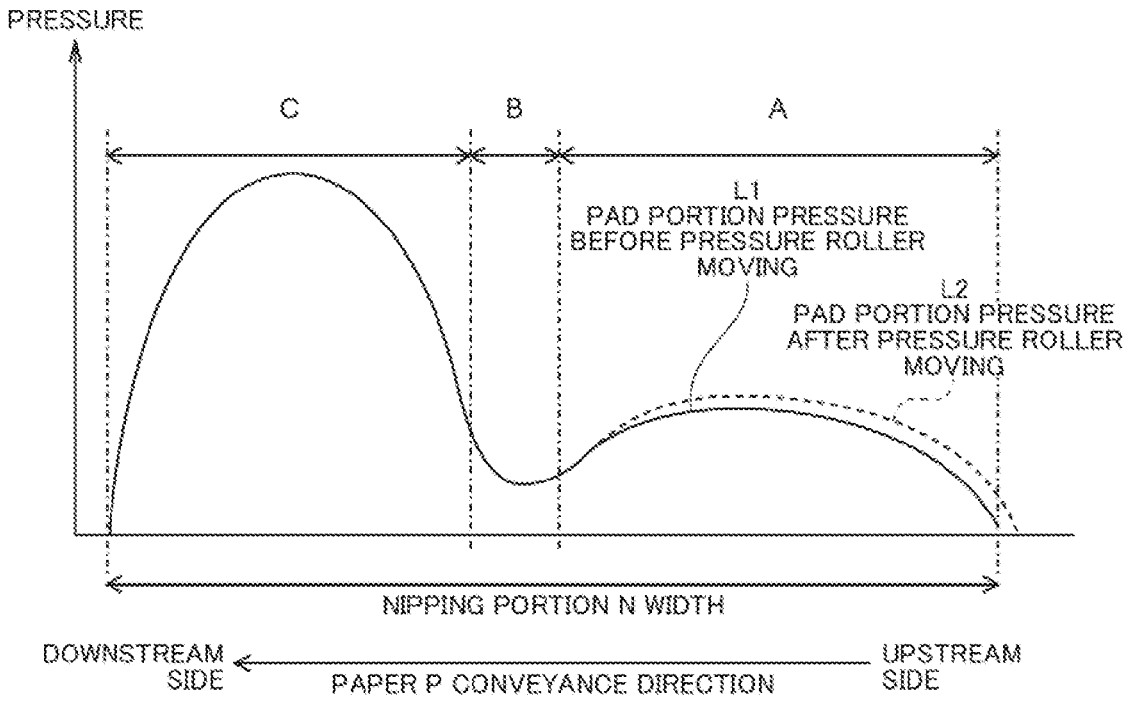
FIG. 9 is a graph showing pressure profile in the nipping portion in the fixing device according to the embodiment.

Next, referring to FIG. 9, changes in a pressure profile of the nipping portion N in accordance with the move of the pressure roller 30, or namely the profile of pressure exerted to the paper P, are described.

In FIG. 9, the ordinate represents the pressure in the respective sections, and the abscissa represents the position on the nipping portion (sections from an end of the nipping portion N on the upstream side of the paper conveyance to an end on the downstream side).

In FIG. 9, L1 shows a pressure profile of the nipping portion N in the state of FIG. 8A or the state before the move of the pressure roller 30, and L2 shows a pressure profile of the nipping portion N in the state of FIG. 8B or the state after the move of the pressure roller 30.

In FIG. 9, the pressure from the fixing roller 32 and the pressure roller 30 is illustrated as Section C. In FIG. 9, the pressure by the pad 40 is illustrated as Section A. In FIG. 9, a section between Section A and Section C, or namely an interval between an end of Section A on the downstream side and an end of Section C on an upstream side, is shown as Section B.

As shown in FIG. 9, where the pressure roller 30 moves, there is no influence to the pressure profile in Section C. That is, even if the pressure roller 30 moves, the pressure in Section C is not subject to any influence and remains as the same. As shown in FIGS. 8A to 8C, even where the pressure roller 30 moves, the positional relation between the fixing roller 32 and the pressure roller 30 resumes to the positional relation determined from the hardness relation between the fixing roller 32 and the pressure roller 30. Accordingly, it can be said that even if the pressure roller 30 moves, the pressure profile of the nipping portion N may not change largely, or in other words, the pressure exerted to the paper P does not change largely. Where the pressure profile of the nipping portion N changes largely according to the move of the pressure roller 30, it may affect even to the fixing processing. If the pressure roller 30 is moved in a range changing slightly the pressure profile of the nipping portion N, the printer 1 can be adjusted easily (e.g., parameter settings of target temperature and printing speed). Even where the pressure member is not a rotary body (pressure roller 30) but replaced with a stable guide covered with a low friction coefficient material, it may bring a state so that the pressure profile in Section C is not influenced, even though the pressure roller 30 moves, by adjusting the hardness relation between the fixing roller 32 and the stable guide described above.

As shown in FIG. 9, due to the movement of the pressure roller 30, the pressure in Section A is increased, as the pushing amount of the pressure roller 30 to the pad 40 increases. With this operation, force tensioning the fixing belt 33 can be strengthened by the pad 40, and the relation of $\theta 1<\theta 2$ can be brought on $\theta 2$ as shown in FIG. 8C. With this structure, where the paper P has a strong rigidity similar to that of cardboard, the toner surface of the paper P is restrained from coming close to the fixing belt 33 before entering into the nipping portion N, thereby improving the fixing property.

In accordance with the printer 1 in this embodiment, where the pressure roller is movable toward the paper guide according to the paper P, and even where the paper P has a strong rigidity like that of cardboard, the toner surface of the paper P can be restrained from coming close to the fixing belt 33 before entering into the nipping portion N. With this structure, the printer 1 prevents gloss unevenness from occurring and obtains adequate fixing property even where the paper P is a cardboard having a high rigidity, thereby obtaining advantages of good printing quality. The printer 1 can effectively prevent wrinkles from occurring during fixing processing and can make good conveyance property and stacking property, or namely can realize stable conveyance and delivery of the paper P, by returning the position of the pressure roller 30 to the normal position, even where the paper P is a thin paper absorbing much moisture under a highly moisturized environment. That is, the printer 1 in this embodiment ensures the good conveyance property and stacking property for thin paper (paper P having a thin thickness), and concurrently realizes better image quality than conventional apparatuses for cardboard or paper P having a thick thickness.

This invention is not limited to the above embodiment, and modified examples as exemplified below are applicable.

Although in the above embodiment it is described that the image forming apparatus according to the invention is applied to multicolor printer, the image forming apparatus according to the invention is not limited to multicolor printers, but is applicable to, e.g., monochrome printer, photocopier, facsimile machine, and MFP, using an electrophotographic method.

Although in the above embodiment it is described that the example uses plain paper as a medium (paper) for printing (image formation), the medium used in the image forming apparatus according to the invention is not limited to plain paper. For example, the image forming apparatus according to the invention is applicable to special papers such as, e.g., OHP sheet, card, postcard, cardboard having a measured weight of 350 g/m$^2$ or more, envelope, and coating paper having a large thermal capacity.

Although in the above embodiment it is described that the example uses the area heater 34 as a heating member (heating source) of the fixing apparatus 14, the sliding surface of the fixing belt 33 may have approximately the same radius of curvature as the fixing belt 33. For example, a cylindrical heater may be used as a heating member (heating source) of the fixing device 14. A halogen heater may be used as a heating member (heating source) of the fixing device 14. Induction heating may be used where the fixing device 14 is structured of a electromagnetically inducible material or materials, and the kind or shape of the heating member (or heater) is not limited.

In the above embodiment, the heater 34 is described as disposed on the inner side of the fixing belt 33, but the heater 34 can be arranged on an outer side of the fixing belt 33.

Although in the above embodiment the pressure member move mechanism moving the pressure roller 30 is structured in using, e.g., the pressure roller move cam 44 and the pressure roller move motor 382, specific structures of the pressure member move mechanism are not limited to the above structure. That is, the pressure member move mechanism is not limited to any specific structure as far as making the pressure roller 30 move in a prescribed direction for a prescribed amount. For example, the pressure roller 30 may be moved using a drive member such as, e.g., a solenoid instead of the pressure roller move cam 44, and the pressure roller move motor 382.

Although in the above embodiment it is described that the pressure roller 30 is moved to any of the two positions (normal position and cardboard position), the number of the positions to which the pressure roller 30 moves is not limited specifically. For example, the pressure roller 30 may be made movable to three positions or more, and the printer controller 50 (fixing controller 53) may make the pressure roller 30 move to the positions according to the kinds (e.g., thickness, material, rigidity) of the paper P.

Although in the above embodiment the printer controller 50 (fixing controller 53) obtains the thickness of the paper P using the paper thickness sensor 261, the thickness of the paper P may be obtained according to, e.g., user's manipulation or setting. That is, the method of obtaining the thickness of the paper P at the printer controller 50 (fixing controller 53) is not limited specifically.

Although in the above embodiment the position of the pressure roller 30 is adjusted according to the thickness of the paper P, the position of the pressure roller 30 may be adjusted according to the kind and specification of the paper P, other than the thickness of the paper P. For example, the pressure roller 30 may be moved to the normal position for the plain paper, whereas the pressure roller 30 may be moved to the cardboard position for special papers such as, e.g., OHP sheet, card, postcard, cardboard having a measured weight of 350 g/m2 or more, envelope, and coating paper having a large thermal capacity.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming apparatus having a fixing device for fixing developer on a medium, the fixing device comprising:

a heating member;

an endless belt member subject to heating provided from the heating member;

a tension member tensioning the endless belt member;

a pressure member forming a pressurized contact nipping portion via the endless belt member;

a supporting member supporting the pressure member;

a pushing member pushing the pressure member and the endless belt member;

a fixing member pushing the pressure member and the endless belt member;

a medium guide guiding movement of the medium in a direction toward the pressurized contact nipping portion;

a pressure member moving mechanism for moving a position of an axis of rotation of the pressure member relative to the supporting member in a lateral direction toward the medium guide; and a controller controlling the position of the pressure member via the pressure member moving mechanism.

2. The image forming apparatus according to claim 1, wherein the pressure member moving mechanism moves the pressure member from a first position to a second position.

3. The image forming apparatus according to claim 2, wherein the second position is placed a prescribed distance closer to the medium guide than the first position.

4. The image forming apparatus according to claim 3, wherein the controller moves the position of the pressure member in accordance with a thickness of the medium.

5. The image forming apparatus according to claim 4, wherein the controller moves the pressure member from the first position to the second position when recognizing that the medium has a thickness equal to or greater than a prescribed thickness.

6. The image forming apparatus according to claim 1, wherein the controller moves the pressure member in association with a kind of the medium.

7. The image forming apparatus according to claim 6, wherein the controller changes temperature of the endless belt member using the heating member in association with the kind of the medium.

8. The image forming apparatus according to claim 6, further comprising a medium sensor detecting the kind of the medium and sending information of the kind of the medium to the controller.

9. The image forming apparatus according to claim 1, wherein the pressure member is formed with a pressure roller having a shaft supported by a bearing member, and wherein the pressure member moving mechanism is formed with a cam, the cam shifting the position of the bearing member.

10. The image forming apparatus according to claim 9, wherein the cam pushes the bearing member in a horizontal direction in opposition to force of a spring provided at the bearing member.

11. The image forming apparatus according to claim 1, wherein the pressure member is formed with a pressure roller having a shaft supported by a bearing member, wherein the pressure member moving mechanism includes a cam, the cam shifting the position of the bearing member, and wherein the cam causes the pressure member to move relative to the support member.

12. The image forming apparatus according to claim 9, wherein the cam causes the pressure member to move relative to the support member.

13. The image forming apparatus according to claim 9, wherein the cam causes an axis of rotation of the pressure member to shift relative to the support member.

14. The image forming apparatus according to claim 9, wherein the cam causes the bearing member to move relative to the support member.

15. The image forming apparatus according to claim 10, wherein the cam causes the bearing member to move relative to the support member.

16. An image forming apparatus having a fixing device for fixing developer on a medium, the fixing device comprising:

a heating member;

an endless belt member subject to heating provided from the heating member;

a tension member tensioning the endless belt member;

a pressure member forming a pressurized contact nipping portion via the endless belt member;

a supporting member supporting the pressure member;

a pushing member pushing the pressure member and the endless belt member;

a fixing member pushing the pressure member and the endless belt member;

a medium guide guiding movement of the medium in a direction toward the pressurized contact nipping portion;

a pressure member moving mechanism for moving a position of the pressure member in the supporting member; and a controller controlling the position of the pressure member via the pressure member moving mechanism, wherein the pressure member moving mechanism moves the pressure member from a first position to a second position, and wherein an angle made from a first plane extending from a contact nipping start portion to a most downstream point of a top surface of the medium guide in the medium conveyance direction and a second plane extending from a most downstream point of a bottom surface the tension member on a downstream side in the medium conveyance direction to an end of the pushing member on an upstream side in the medium conveyance direction is structured to be larger where the pressure member is located at the second position than where the pressure member is located at the first position.

17. A fixing device for fixing developer to a medium, comprising:

a heating member;

an endless belt member subject to heating provided from the heating member;

a tension member tensioning the endless belt member;

a pressure member forming a pressurized contact nipping portion via the endless belt member;

a supporting member supporting the pressure member;

a pushing member pushing the pressure member and the endless belt member;

a fixing member pushing the pressure member and the endless belt member;

a medium guide guiding movement of the medium in a direction toward the pressurized contact nipping portion; and a pressure member moving mechanism for moving a position of an axis of rotation of the pressure member relative to the supporting member in a lateral direction toward the medium guide.

* * * * *